US011597175B1

(12) United States Patent
Terminella

(10) Patent No.: US 11,597,175 B1
(45) Date of Patent: Mar. 7, 2023

(54) FORMER WITH INSERT

(71) Applicant: Joseph E. Terminella, Fayetteville, AR (US)

(72) Inventor: Joseph E. Terminella, Fayetteville, AR (US)

( * ) Notice: Subject to any disclaimer, the term of this patent is extended or adjusted under 35 U.S.C. 154(b) by 630 days.

(21) Appl. No.: 16/450,828

(22) Filed: Jun. 24, 2019

Related U.S. Application Data

(63) Continuation-in-part of application No. 14/214,715, filed on Mar. 15, 2014, now Pat. No. 10,953,619.

(51) Int. Cl.
*B31B 70/26* (2017.01)
*B31B 155/00* (2017.01)

(52) U.S. Cl.
CPC ..... *B31B 70/26* (2017.08); *B31B 2155/00* (2017.08)

(58) Field of Classification Search
CPC ..... B31B 70/26; B31B 2155/00; B31B 1/28; B31B 3/28; B31B 2219/2609; B65B 9/123; B65B 9/20; B65B 9/2028
USPC ..... 493/180; 53/451, 551, 550, 554
See application file for complete search history.

(56) References Cited

U.S. PATENT DOCUMENTS 3,122,072 A * 2/1964 Monsees ..... B65B 9/22 493/465
3,415,171 A * 12/1968 Wilson ..... B65B 59/001 53/551
3,962,958 A * 6/1976 Hobart ..... B65B 9/22 53/551
5,707,329 A * 1/1998 Pool ..... B65B 9/2028 53/551
6,589,147 B2 * 7/2003 Dominguez, Jr. ..... B65B 9/20 493/295

* cited by examiner

*Primary Examiner* — Sameh Tawfik
(74) *Attorney, Agent, or Firm* — Schrantz Law Firm, PLLC; Stephen D. Schrantz

(57) ABSTRACT

A former provides an insert at the lip of the former to enable packaging material to travel smoothly over the former. The insert lays smoothly on the top surface of the former. The insert is sized approximately one half the width of the packaging material that travels over the insert. The former provides a raised textured surface that enables the packaging material to travel over the former into the aperture. The insert constructed with a smooth top surface is located adjacent at least a portion of the aperture. The insert provides a smooth surface for the packaging material to travel across when entering the aperture.

20 Claims, 3 Drawing Sheets

FORMER WITH INSERT

CROSS-REFERENCE TO RELATED APPLICATIONS

This application is a continuation in part of U.S. patent application Ser. No. 14/214,715 filed on Mar. 15, 2014 entitled FORMER WITH INSERT.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

I. Field of the Invention

The present invention relates to an improved former with insert for use in a bag manufacturing and bag filling packaging machine.

Packaging machines automatically place various types of goods and products into sealed plastic or paper or foil bags. The packaging machine forms the packages or bags and fills them with the desired quantity of the product all in one continuous operation.

A packaging material such as a web of flexible packaging material is pulled over and through a former wherein a selected quantity of the product to be packaged is inserted into the packaging material by way of the tube-forming passage in the former. However, the former is rather difficult to fabricate. The shape and dimensions of the former are critical. If the factors of the former are not correct within a close tolerance, the packaging material may be wrinkled or scratched or broken as it is pulled over and through the former. Such wrinkles, scratches, and tears affect the quality and integrity of the packaging which increases costs and the number of damaged products.

Formers have been fabricated in a largely manual manner with their final shape being arrived at on a trial and error basis. The former is first put together on an intuitive basis and then tested to see the functioning of the former. The former is then modified in an attempt to eliminate any undesired effects. This process is repeated until a shape is finally obtained which produces an acceptable quality for the resulting packages. This trial and error method is time consuming and not economical.

II. Description of the Known Art

The present invention is needed to manufacture and develop improved formers for use in bag manufacturing and bag filling packaging machine. While formers and formulas defining the dimensions of a former exist as taught in U.S. Pat. Nos. 3,636,826 and 6,811,530 and U.S. Publication No. 20070196635, the present invention enables the manufacture and modification of formers to improve the functionality of a former.

Patents and patent applications disclosing relevant information are disclosed below. These patents and patent applications are hereby expressly incorporated by reference in their entirety.

U.S. Pat. No. 6,811,530 entitled Bag Manufacturing former laminated files issued to Watanabe, et al. on Nov. 2, 2004 ("the '530 patent") teaches a former that is used to manufacture a bag in a packaging machine. The '530 patent teaches that a radius of curvature of the former top along a film guiding direction is between 0.27 mm and 0.50 mm, the average surface roughness of the former top is less than 10 .mu.m, and the number of high projections per unit length of 10 mm of the former top along a width direction of the film guided by the insert into the cylinder. The high projection taught by the '530 patent is defined as a projection of the surface of the former top that is as tall as or taller than 5 times the average surface roughness of the former top. The '530 patent teaches that it is found that the minimum radius of curvature of the former top should be equal to or larger than the critical radius that is defined by a radius of the curvature which causes an elastic limit strain at an innermost portion of a support layer of a laminated film immediately outside a barrier layer of the laminated film when the laminated film is bent over the former top. The '530 patent teaches that this makes it possible to effectively avoid undesired increase in oxygen transmission of the bag made of the laminated film.

The '530 patent teaches that it has found that an important reason responsible for gas barrier property deterioration is the distortion which occurs when the laminated films are forced to bend over the top of the former 1, with the distortion causing cracks in the barrier layers. In particular, the '530 patent teaches that a strong tensile force occurs in the vicinity 5 of the center of the former (shown in FIG. 2), causing crack formation. Further, the '530 patent teaches that a smaller radius of curvature 23 on a top of the former (shown in FIG. 3) and a large surface roughness at the top of the former will produce cracks with a higher frequency. In order to solve this problem, the '530 patent teaches that it found it effective, when conventional laminated films for bag formation are used, to increase the radius of curvature on the top of the former or to reduce the surface roughness thereof. However, if there is an excessive increase in the radius of curvature on the top of the former, the '530 patent teaches that wrinkles will occur in the films, causing a stripe defect.

On the other hand, if the radius of curvature on the top of the former is to be adjusted and the surface roughness thereof is to be improved, the '530 patent teaches that there will be an increase in the total production cost. The '530 patent teaches for this reason that it is required that any improvement be effected within an area which is as small as possible on the top of the former. The '530 patent teaches that it has found that the portion of the top 22 of the former 1 causing barrier property deterioration is the portion 5 defined by the central cylinder angles between +30 degrees and −30 degrees based on experiments on the formers and numerical calculations. This top portion taught by the '530 patent is shown in the expanded view 25 in FIG. 3 as a former top 24, which acts as a film bending corner that changes the direction of the film propagation. Accordingly, the former top 24, taught by the '530 patent, refers to the portion of the top of the former 1 which is located between +30 degrees and −30 degrees of the central cylinder angles and changes the direction of the film propagation.

As a method for adjusting the radius of curvature of the former top 24, a file taught by the '530 patent is used to grind the former top 24. The '530 patent teaches that any commonly used chamfering process may also be used. Another method taught by the '530 patent which can be used for the same purpose is to weld a wire having a diameter of 0.37-0.5 mm to the former top 24.

U.S. Pat. No. 3,636,826 issued to Bowen, et al. on Jan. 25, 1972 ("the '826 patent") teaches that the folding shoe described therein is rather difficult to fabricate. The '826 patent teaches that its shape and dimensions are critical. If such factors are not just right, to within a fairly close tolerance, the '826 patent teaches that the packaging material may be wrinkled or scratched or broken as it is pulled over and through the folding shoe. Heretofore, the '826 patent teaches that such folding shoes have been fabricated in a largely manual manner with their final shape being arrived at on a trial and error basis. The shoe taught by the '826 patent is first put together on an intuitive basis and then tested to see what happens. The '826 patent teaches that the shoe is then modified in an attempt to eliminate any undesired effects. After this, the '826 patent teaches that it is again tested to see what happens and any necessary further modifications are made. The '826 patent teaches that this process is repeated until a shape is finally obtained which produces an acceptable quality for the resulting packages.

European Patent EP1415912 teaches that the forming shoulder 5 has two separate parts 8.9 shoulder for receiving the film web 2. An adjusting device 10 is provided for changing and fixing a distance (d) between the shoulder portions 8, 9.

U.S. Pat. No. 6,589,147 issued to Dominguez et al. on Jul. 8, 2003 (hereinafter referred to as the '147 patent) teaches a former whose wing component incorporates periodic openings, a tube component (that may, or may not, incorporate periodic openings) and a base component (that is shaped to conform substantially to the former's tube geometry) is described. Such a former taught by the '147 patent, may be significantly less heavy than prior art formers (for a given size package) while simultaneously providing improved performance and durability. A former assembly that includes the former, a cross-bar, a top-plate and spacers is also described in the '147 patent. Each of the cross-bar, top-plate and spacers taught by the '147 may use aluminum and/or incorporate hollowed pockets to further reduce the assemblies weight.

SUMMARY OF THE INVENTION

The present invention relates to a former with insert to improve the performance of the bagging machine. During the operation of a bagging machine, packaging material such as a web of flexible packaging material, film, or rollstock is processed through the bagging machine. The packaging material could be a material such as a plastic including but not limited to polyethylene, polypropylene, acrylic, cast-polypropylene, cellophane, polyester, other plastics, or a pliable material. The packaging material is drawn through the former to create packaging. The former includes a forming shoulder, a forming lip, and a forming aperture. The packaging material is drawn over the forming shoulder and the forming lip at the forming aperture.

Product packaged by a packaging machine may include material including, but not limited to liquids, powders, solids, flowable material, and bulk material. The packaging material is typically a thin film with text and graphics that identify the product and supplier. The Former manipulates package material into the desired shape (e.g., a rectangular or elliptical bag) and forms the seal for the packaging. The packaging system provides the product and seals the packaging to form an enclosed volume.

Product and packaging material are introduced to the former where the packaging material is shaped and aligned by the former to conform about a product filling tube and to form a seam. The seam is longitudinally sealed by a sealing device.

The packaging systems operate at high speeds and for long periods of time. Therefore, the former is constructed of material that is strong, rigid, and wear resistant. It would be another benefit of the former to be constructed from a non-corrosive material. The former should provide low resistance to the packaging material to reduce the wear of the former as the packaging material is pulled over the former. Wear in the former and the design of the former could potentially create uneven seams, wrinkles, or creases and could potentially tear the packaging material as it is pulled over the former.

The former of the present invention provides an insert applied to the former. The insert provides additional reinforcement at the location in which the packaging material travels over the former. The insert is constructed from a thicker sheet metal than the former. The insert is secured to the former such that the insert is secured flush with the former. The upper surface of the insert is level with the upper surface of the shoulder to form a level transition from the upper surface of the shoulder to the upper surface of the insert. The insert provides a smooth surface for the packaging material to travel across the former and into the aperture. The increased thickness of the insert provides additional reinforcement and enables the packaging material to travel more smoothly across the former. The insert also improves flow of the packaging material with a pre-applied zipper over the former. The insert allows the travel of the pre-applied zipper across the former during the packaging process.

It is an object of the invention to provide a new and improved former for use in a packaging machine.

It is another object of the present invention to improve the travel of packaging material with and without a pre-applied zipper across the former.

It is another object of the present invention to provide a more economical method and system of designing, manufacturing, and/or fabricating a former.

It is another object of the present invention to provide a former that reduces bunches and snags in the packaging material as the packaging material passes over the former.

These and other objects and advantages of the present invention, along with features of novelty appurtenant thereto, will appear or become apparent by reviewing the following detailed description of the invention.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
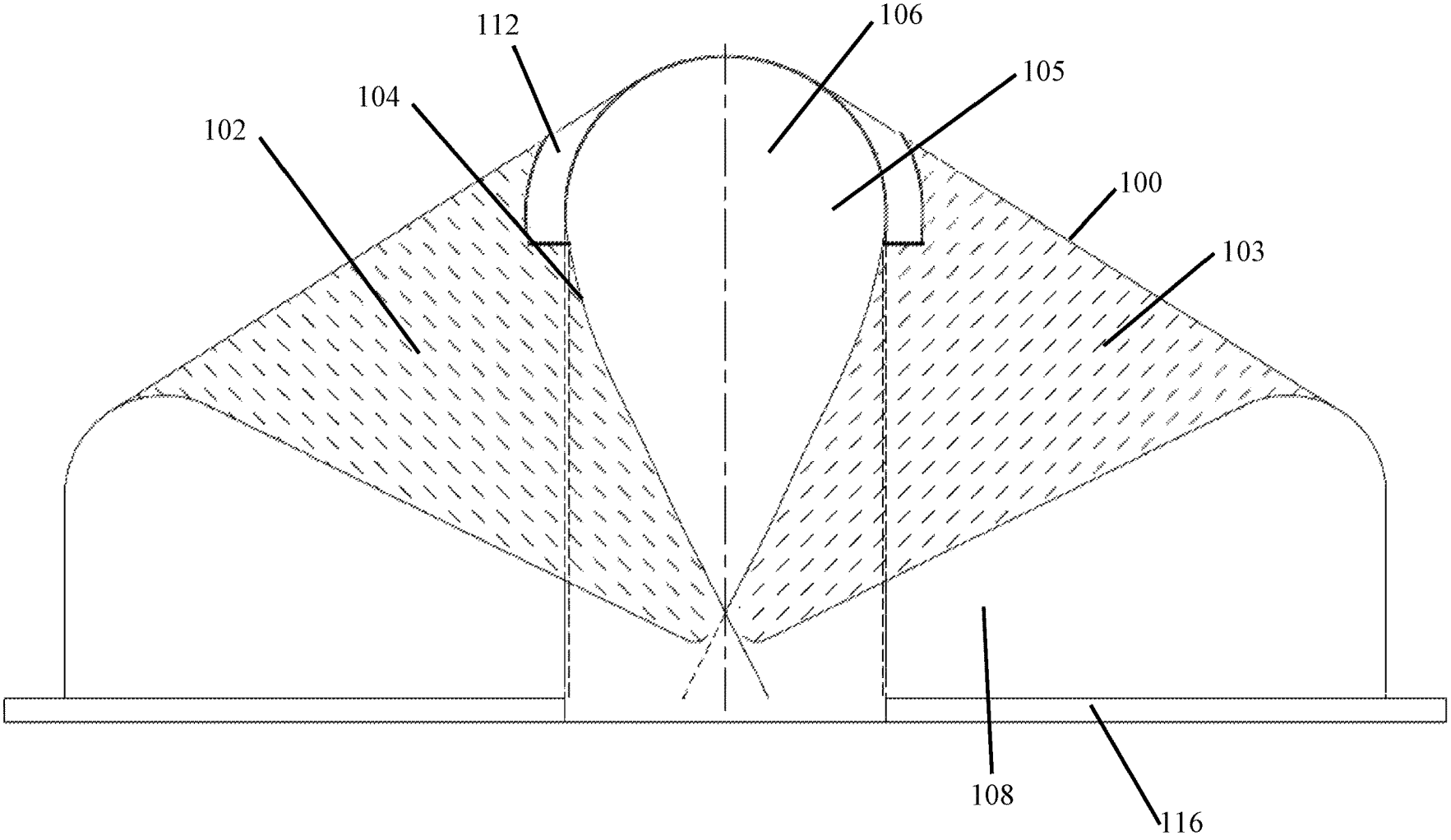
FIG. 1 is a front view of a former of one embodiment of the present invention.

FIG. 1 shows one embodiment of the former generally shown as 100. The former 100 provides a forming shoulder 102, a forming lip 104, a forming aperture 106, and a forming back 108. A packaging material, such as a web of flexible packaging material, is pulled over and through a former wherein a selected quantity of the product to be packaged is inserted into the packaging material by way of the tube-forming passage, forming aperture 106, in the former. The packaging material is drawn across the forming back 108, the forming shoulder 102, and the forming lip 104 into the forming aperture 106. The shape and dimensions of the former are critical. If the factors of the former are not correct within a close tolerance, the packaging material may be wrinkled or scratched or broken as it is pulled over and through the former. Such wrinkles, scratches, and tears affect the quality and integrity of the packaging which increases costs and the number of damaged products.

Figure 2:
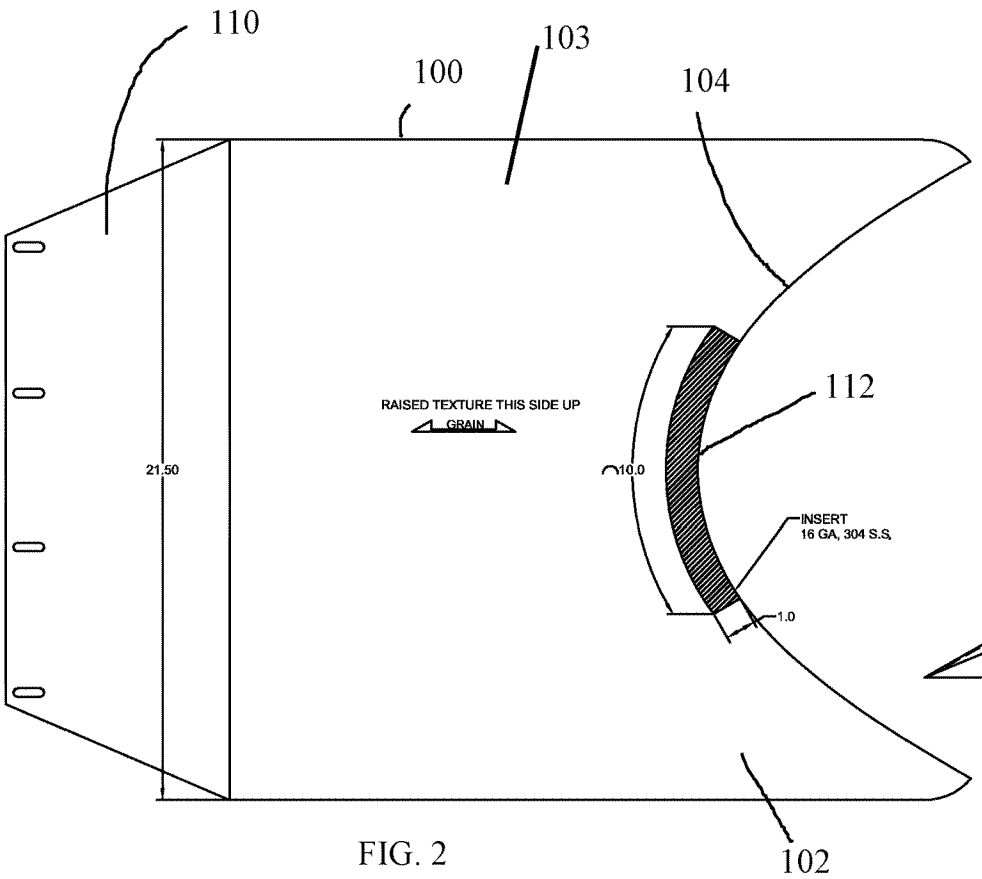
FIG. 2 is a top view of a flat former of one embodiment of the present invention.

FIG. 2 shows the flat former 100 prior to shaping. The former 100 provides a reinforced insert 112 at lip 104. This insert 112 is constructed from a metal including but not limited to stainless steel, chrome, a hard chrome, nickel, electroless nickel, baked nickel, or other metal. In one embodiment, the insert 112 is welded onto the former 100 such that the insert 112 is flush with the former 100 and forming back 108. The upper surface of the insert is flush with the upper surface of the forming back to form a planar surface between the upper surface of the insert and the upper surface of the forming back. The upper surface of the insert is flush with the upper surface of the shoulder to form a planar surface between the upper surface of the insert and the upper surface of the shoulder for a level transition from the upper surface of the shoulder to the upper surface of the insert. The upper surface of the insert is level with the upper surface of the shoulder to form a level transition from the upper surface of the shoulder to the upper surface of the insert. The insert 112 may extend a half inch to two inches, preferably one inch, onto the top of the former 100. The insert 112 is welded at the top of the former 100 and the bottom of the former 100 such that the insert provides smooth transition to the top of the former 100 at lip 104.

In one embodiment, the insert 112 extends for approximately 6 to 20 inches, preferably 10 inches or one half (½) the width of the packaging material, such as the web, along the lip 112. The insert 112 provides additional reinforcement while the packaging material of material passes over the former 100 and through the former lip 112 into forming aperture 106. In one embodiment, the insert 112 is constructed from a 16 gauge stainless steel.

The insert 112 of one embodiment may be sized according to the width of the packaging material. The length of the insert 112 running along the lip 104 is sized to be at least half the width of the packaging material. In one embodiment, the length of the insert running along the lip 104 is approximately one half the width of the packaging material. The insert 112 assists with the smooth transfer of the packaging material with zipper through the aperture 106.

Continuing to refer to FIGS. 1 and 2, the top of the former 100 provides a raised textured surface. This raised textured surface of former 100 decreases friction between the packaging material and the former 100. The forming shoulder 102 and forming back 108 provide a raised texture surface located along the upper surface of the former 100. Therefore, the packaging material may smoothly transition over the former 100 and into the forming aperture 106.

The former of one embodiment is sized such that the maximum height of the former as shown in FIG. 1 is 12 inches. The width of one embodiment as shown in FIG. 1 may range from 17 inches to 26 inches, preferably 21.5 inches. Such a former may be constructed such that the former 100, including forming shoulder 102 and forming back 108, are constructed from 20 gauge chrome plated stainless steel.

The flush body 110 secured to the former 100 assists in the flow of the packaging material through the former. The flush body 110 assists with the zipper of zippered packaging travelling across the former.

Figure 3:
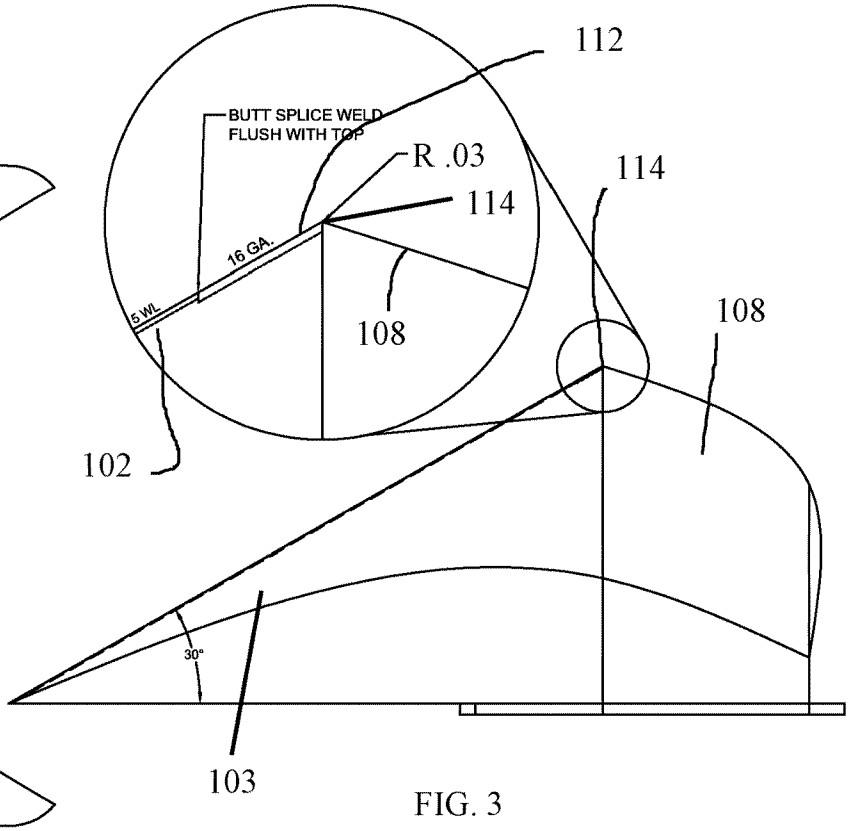
FIG. 3 is a left side view of a former of one embodiment of the present invention, the right side view being a mirror image of the left side.
Figure 4:
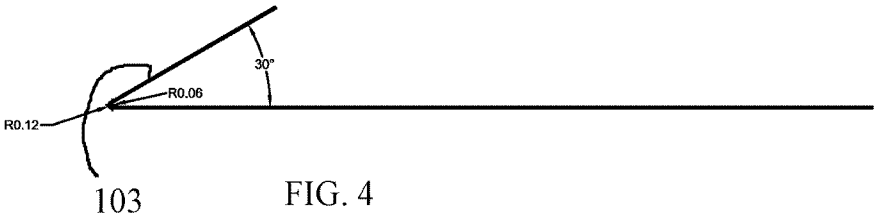
FIG. 4 is a left side view of a former of one embodiment of the present invention, the right side view being a mirror image of the left side.

FIGS. 3 and 4 show the angles of one embodiment of the former 100. At junction 114 where insert 112 meets forming shoulder 102, the curve at junction 114 is based upon a radius of approximately 0.03 inches. The radius of the curvature at forming aperture 106 is approximately 0.03 inches. The radius of the curvature of the bottom of forming shoulder 102 is 0.06 inches. The forming back 108 and flush body 110 form a 30 degree angle with the base plate 116.

Figure 5:
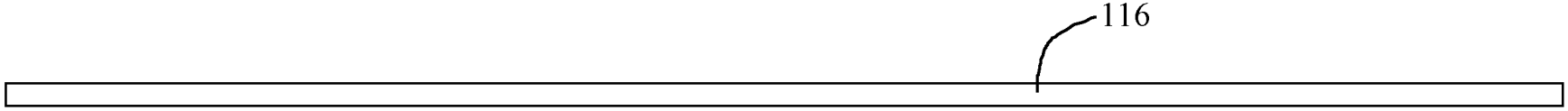
FIG. 5 is a rear view of a plate of one embodiment of the present invention.
Figure 6:
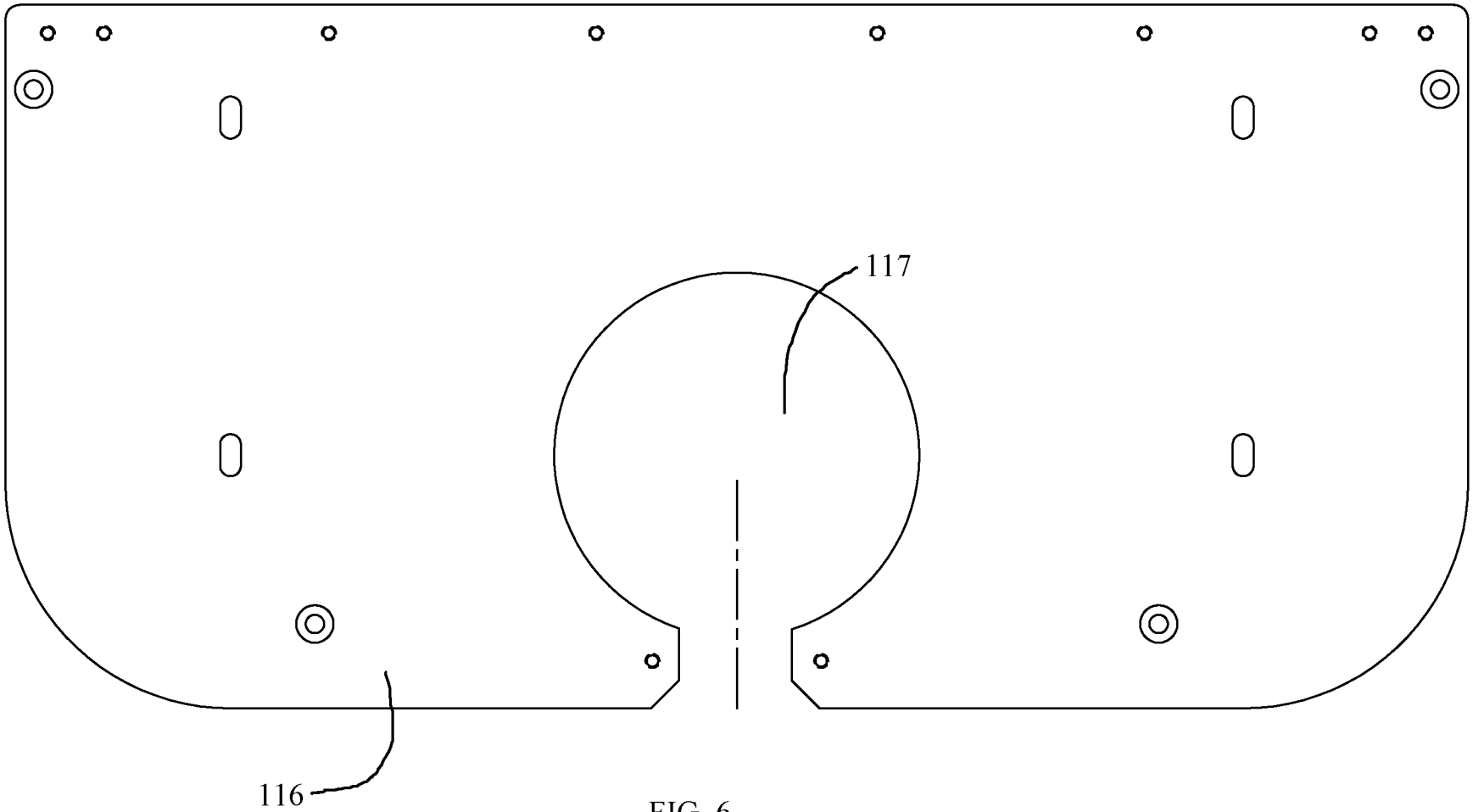
FIG. 6 is a top view thereof.

FIGS. 5 and 6 show the base plate 116 of the former 100. The base plate 116 of one embodiment ranges from 21.5 inches to 34 inches, preferably 26 inches in width. The base plate 116 of one embodiment ranges from ⅛ inch to an inch thick, preferable ⅜ inch thick. The base plate 116 provides an aperture 117 such that the packaging material may pass through the base plate 116. The base plate 116 is located below the former 100 and assists with the bagging process. The base plate 116 is secured to the packaging machine and allows a filling tube 105 to pass through the former 100 at forming aperture 106 and aperture 117 of the base plate 116.

The insert 112 is constructed from a sheet metal with a smooth top surface. The smooth top surface assists with the transfer of the packaging material into the former. The insert 112 is welded to the former such that the insert 112 is secured flush with the former 100 and forming back 108. The upper surface of the insert is flush with the upper surface of the forming back to form a planar surface between the upper surface of the insert and the upper surface of the forming back. The upper surface of the insert is flush with the upper surface of the shoulder to form a planar surface between the upper surface of the insert and the upper surface of the shoulder for a level transition from the upper surface of the shoulder to the upper surface of the insert. The upper surface of the insert is level with the upper surface of the shoulder to form a level transition from the upper surface of the shoulder to the upper surface of the insert. The insert 112 is centrally located at junction 114 where the former 100 begins the downward slope as shown in FIG. 3. The insert 112 of one embodiment is located centrally on curve of lip 104 of former 100. The insert 112 curves with the lip 104 and aperture 106 and runs adjacent at least a portion of the aperture 106 on forming shoulder 102. In one embodiment, the insert 112 is sized at half of the width of the packaging material.

These and other objects and advantages of the present invention, along with features of novelty appurtenant thereto, will appear or become apparent by reviewing the following detailed description of the invention.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A former for use in a packaging machine to guide packaging material to form a bag, the former comprising:

a shoulder for guiding the packaging material towards an aperture in a film guiding direction to form the bag, the shoulder curved along the film guiding direction, the shoulder at least partially enclosing the aperture;

a lip defining an edge of the former adjacent the aperture;

a forming back directing the packaging material upward as the packaging material moves in the film guiding direction;

an upper surface of the shoulder wherein the packaging material travels across the upper surface of the shoulder;

an insert located at the lip, the insert secured to the former wherein the insert is flush with the upper surface of the shoulder, wherein the insert is constructed from a sheet metal separate from the forming back and the shoulder;

an upper surface of the insert wherein the packaging material travels across the upper surface of the insert wherein the upper surface of the insert is flush with the upper surface of the shoulder forming a smooth transition from the upper surface of the shoulder to the upper surface of the insert.

2. The former of claim 1 wherein the forming back has a raised textured surface.

3. The former of claim 1 wherein the shoulder has a raised textured surface.

4. The former of claim 1 wherein the insert is constructed from sheet metal with a flat top surface.

5. The former of claim 4 wherein the insert is welded to the former.

6. The former of claim 5 wherein the insert is welded at the top of the former and the bottom of the former.

7. The former of claim 4 wherein the former is constructed from a sheet metal with a raised textured surface wherein the insert is constructed from thicker sheet metal than the sheet metal of the former.

8. The former of claim 1 wherein the length of the insert adjacent the lip is at least one half of the width of the packaging material.

9. The former of claim 1 wherein the insert is centrally located on the lip.

10. The former of claim 1 wherein the insert is centrally located on the shoulder.

11. A former for use in a packaging machine to guide flexible packaging material to form a bag, the former comprising:

a shoulder for guiding the flexible packaging material towards an aperture in a film guiding direction to form the bag, the shoulder curved along the film guiding direction, the shoulder at least partially enclosing the aperture;

an upper surface of the shoulder wherein the packaging material travels across the upper surface of the shoulder;

a lip defining an edge of the former adjacent the aperture;

a forming back directing the packaging material upward as the packaging material moves in the film guiding direction;

an upper surface of the forming back wherein the packaging material travels across the upper surface of the forming back;

an insert located at the lip wherein the insert is a piece of sheet metal, the insert secured to the former wherein the insert is flush with the forming back, the insert extending downward adjacent the shoulder, wherein the insert is constructed from a sheet metal separate from the forming back and the shoulder;

an upper surface of the insert wherein the packaging material travels across the upper surface of the insert wherein the upper surface of the insert is flush with the upper surface of the forming back to form a planar surface for a smooth transition across the upper surface of the forming back to the upper surface of the insert; and wherein the upper surface of the insert is flush with the upper surface of the shoulder forming a planar surface between the upper surface of the insert and the upper surface of the shoulder.

12. The former of claim 11 wherein the forming back has a raised textured surface.

13. The former of claim 11 wherein the shoulder has a raised textured surface.

14. The former of claim 11 wherein the insert is constructed from sheet metal with a smooth top surface.

15. The former of claim 14 wherein the insert is welded to the former.

16. The former of claim 11 wherein the length of the insert adjacent the lip is at least one half of the width of the packaging material.

17. The former of claim 11 wherein the insert is centrally located on the shoulder.

18. A former for use in a packaging machine to guide flexible packaging material to form a bag, the former comprising:

a shoulder for guiding the flexible packaging material towards an aperture in a film guiding direction to form the bag, the shoulder curved along the film guiding direction, the shoulder at least partially enclosing the aperture;

an upper surface of the shoulder wherein the packaging material travels across the upper surface of the shoulder;

a lip defining an edge of the former adjacent the aperture;

a forming back directing the packaging material upward as the packaging material moves in the film guiding direction, the forming back constructed from a sheet metal;

an upper surface of the forming back wherein the packaging material travels across the upper surface of the forming back;

an insert located at the lip, the insert secured to the former wherein the insert is flush against the forming back, the insert extending downward adjacent the shoulder wherein the insert is located along the lip, the insert constructed from a sheet metal with a smooth top surface, wherein the insert is constructed from a sheet metal separate from the forming back and the shoulder;

an upper surface of the insert wherein the packaging material travels across the upper surface of the insert, wherein the upper surface of the insert is flush with the upper surface of the forming back forming a planar surface across the upper surface of the insert and the upper surface of the forming back for a smooth transition across the upper surface of the forming back to the upper surface of the insert;

wherein the upper surface of the insert is flush with the upper surface of the shoulder to form a planar surface between the upper surface of the insert and the upper surface of the shoulder for a level transition from the upper surface of the shoulder to the upper surface of the insert;

wherein the forming back and shoulder are constructed from a first sheet metal and the insert is constructed from a second sheet metal wherein the insert is constructed from thicker sheet metal than the first sheet metal of the forming back and shoulder.

19. The former of claim 18 wherein the shoulder has a raised textured surface.

20. The former of claim 19 wherein the length of the insert adjacent the lip is one half of the width of the packaging material.

* * * * *